US007478534B2

(12) United States Patent
Guezengar et al.

(10) Patent No.: US 7,478,534 B2
(45) **Date of Patent: *Jan. 20, 2009**

(54) ARRANGEMENT WITH A TWIST-LOCK COUPLING FOR A TURBOMACHINE COMBUSTION CHAMBER

(75) Inventors: Dominique Guezengar, Arpajon (FR); Didier Hippolyte Hernandez, Quiers (FR); Thomas Olivier Marie Noel, Vincennes (FR); Michel Zischek, Courquetaine (FR)

(73) Assignee: SNECMA, Paris (FR)

( * ) Notice: Subject to any disclaimer, the term of this patent is extended or adjusted under 35 U.S.C. 154(b) by 26 days.

This patent is subject to a terminal disclaimer.

(21) Appl. No.: 11/770,309

(22) Filed: Jun. 28, 2007

(65) Prior Publication Data

US 2008/0202122 A1 Aug. 28, 2008

(30) Foreign Application Priority Data

Jun. 29, 2006 (FR) ..... 06 52716

(51) Int. Cl.
*F02C 7/20* (2006.01)

(52) U.S. Cl. ..... 60/796; 60/748

(58) Field of Classification Search ..... 60/796, 60/752, 801, 748, 798
See application file for complete search history.

(56) References Cited

U.S. PATENT DOCUMENTS 4,263,780 A * 4/1981 Stettler ..... 60/39.23
4,454,711 A * 6/1984 Ben-Porat ..... 60/800
5,894,732 A 4/1999 Kwan
6,880,341 B2 * 4/2005 Parkman et al. ..... 60/740
2007/0186558 A1 * 8/2007 De Sousa et al. ..... 60/804
2008/0010990 A1 * 1/2008 Shi et al. ..... 60/772

FOREIGN PATENT DOCUMENTS

EP 1 258 681 A2 11/2002
EP 1 314 933 A1 5/2003
FR 2 679 010 A1 1/1993

OTHER PUBLICATIONS

U.S. Appl. No. 11/768,421, filed Jun. 26, 2007, Commaret et al.
U.S. Appl. No. 11/770,309, filed Jun. 28, 2007, Guezengar et al.

* cited by examiner

*Primary Examiner*—William H Rodriguez
*Assistant Examiner*—Vikansha S Dwivedi
(74) *Attorney, Agent, or Firm*—Oblon, Spivak, McClelland, Maier & Neustadt, P.C.

(57) ABSTRACT

The invention relates to an arrangement for a turbomachine combustion chamber, the arrangement comprising a chamber end wall pierced by at least one opening, an injector system, and a deflector mounted on the downstream side of the chamber end wall in the opening by means of an annulus, said injector system including a pinch ring mounted on the upstream side and fastened against the annulus with the pinch ring and the annulus together defining a groove, and a bowl mounted in the opening, the bowl being made up of at least two distinct parts, at least a first part forming an end plate suitable for sliding radially in the groove, and a second part forming a bowl collar that is provided with a collar extending parallel to the chamber end wall on its downstream side, said first and second bowl parts being fastened together by means of a twist-lock coupling.

12 Claims, 5 Drawing Sheets

FIG.5
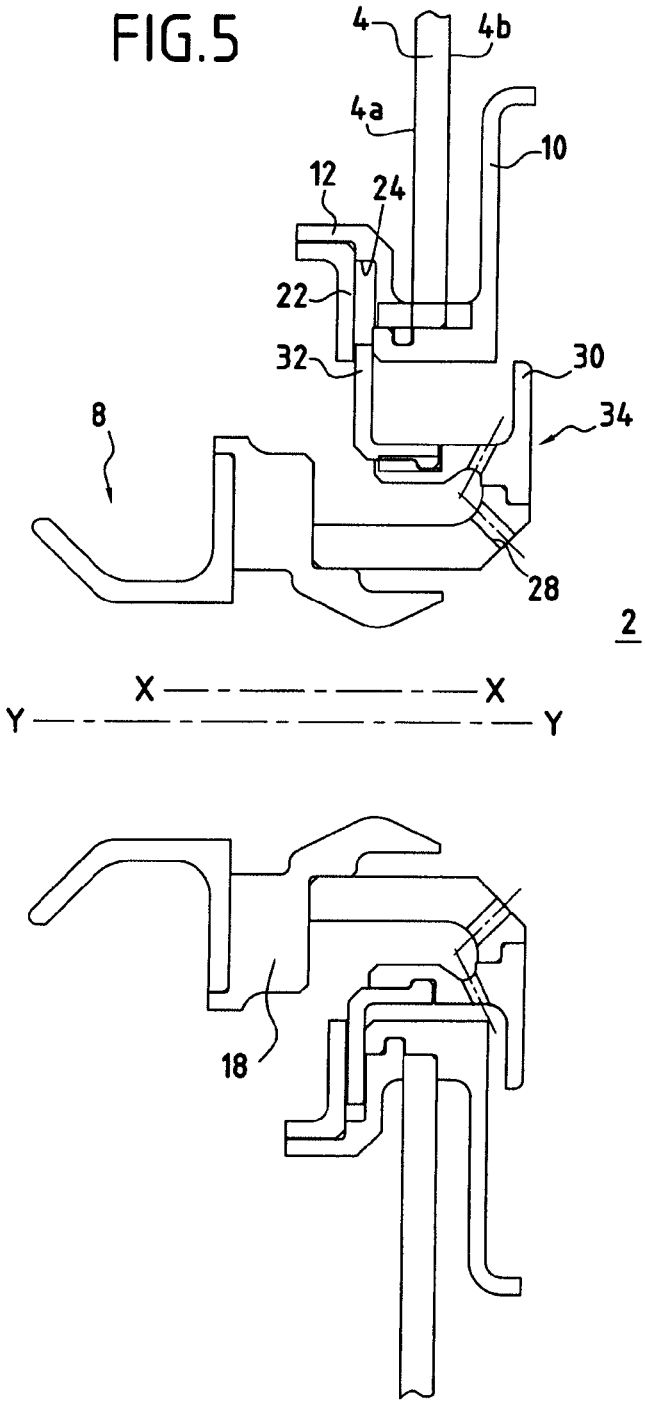
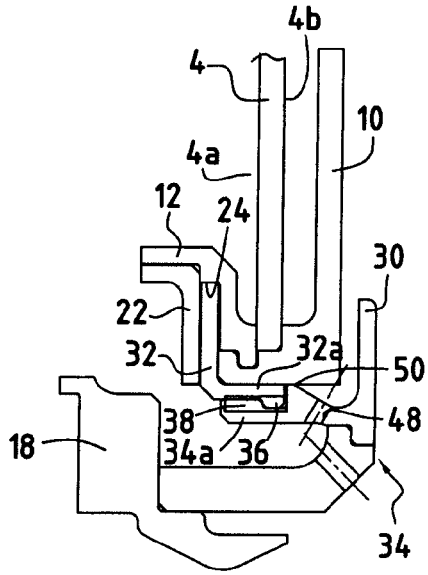
FIG.6

ARRANGEMENT WITH A TWIST-LOCK COUPLING FOR A TURBOMACHINE COMBUSTION CHAMBER

BACKGROUND OF THE INVENTION

The present invention relates to the general field of turbomachine combustion chambers. It relates more particularly to an arrangement for a combustion chamber of the type comprising a chamber end wall pierced by at least one circular opening, an injector system associated with the opening, and a deflector mounted on the downstream side of the chamber end wall in the opening.

In general, an annular combustion chamber of a turbomachine comprises two longitudinal annular walls (an inner wall and an outer wall) that are interconnected at their respective upstream ends by a transverse wall that is likewise annular and that forms a chamber end wall. The chamber end wall includes a plurality of circular openings that are regularly spaced apart and in which there are mounted injector systems for injecting an air/fuel mixture that is to burn inside the combustion chamber.

The fuel is delivered to the injector system via injectors secured to the casing of the turbomachine and having heads centered on the injector system. Air is introduced into each injector system by means of one or more air swirlers that open out downstream from the fuel injector head. In addition, a downwardly-flared bowl is mounted in each opening so as to ensure that the air/fuel mixture is well distributed in the primary zone of the combustion area. Finally, a deflector mounted in each opening in the chamber end wall on the downstream side thereof serves to provide the chamber end wall with thermal protection against the high temperatures of the gas that results from combustion of the air/fuel mixture in the combustion chamber.

Thermal expansion differences exist between the turbomachine casing to which the fuel injectors are connected and the walls of the combustion chamber. In order to accommodate these expansion differences, it is therefore necessary to provide a certain amount of freedom of movement between the combustion chamber and the injector systems. For this purpose, provision can be made to center the fuel injector heads on a sliding cross-member capable of moving radially relative to the injector system (reference can be made for example to document EP 0 833 107). Alternatively, in certain circumstances, lack of concentricity between the injector and the associated injection system is unacceptable, so expansion differences must be accommodated by sliding the injector system relative to the chamber end wall. The invention relates to an arrangement of that latter type.

Such an arrangement must comply with another constraint. In the event of a break in one of the brazed or welded connections connecting together the component parts of the arrangement, it is essential to ensure that none of these parts becomes detached and falls into the combustion chamber where there is a risk it would damage the high pressure turbine mounted at the outlet from the chamber. In order to counter such an event, it is known to give the component parts of the arrangement a diameter that is greater than the diameter of the opening in the chamber end wall and to mount them from the upstream side of the chamber end wall.

Furthermore, it is common practice to provide the bowl of the injector system with a collar that projects inside the chamber end wall and that extends parallel thereto. The main function of such a collar is to protect the injector system against combustion flames in the event of the injector system being off-centered relative to the chamber end wall. Unfortunately, with an arrangement in which the component parts are mounted from the upstream side of the chamber end wall, the bowl collar that needs to pass through the opening in the chamber end wall necessarily presents a diameter that is smaller than the diameter of the opening. Thus, in the event of the injector system being significantly off-centered relative to the chamber end wall, the bowl collar no longer performs its function of providing thermal protection against combustion flames.

OBJECT AND SUMMARY OF THE INVENTION

The present invention thus has a main object of mitigating such drawbacks by providing a turbomachine combustion chamber arrangement that makes it possible firstly to avoid one of its component parts dropping into the inside of the combustion chamber in the event of a welded or brazed connection breaking, and secondly to have a bowl collar that performs its thermal protection function regardless of the extent to which the injector system becomes off-centered relative to the chamber end wall.

These objects are achieved by an arrangement in which the injector system comprises a pinch ring mounted on the upstream side of the chamber end wall and fastened against the annulus so that together they define an annular groove that is open towards the axis of the opening in the chamber end wall, and an annular bowl mounted in the opening of the chamber end wall, and in which, in accordance with the invention, the bowl is made up of at least two distinct parts, at least a first part forming an annular end plate suitable for sliding radially in the groove formed by the pinch ring and the annulus, and second part forming a bowl collar provided with an annular collar that extends parallel to the chamber end wall of the downstream thereof, said first and second bowl parts being fastened to each other by means of a twist-lock coupling.

With such an arrangement, thermal expansion differences between the casing and the combustion chamber are accommodated by the injector system sliding relative to the chamber end wall. Since the bowl is made of at least two parts, one of which corresponds to the bowl collar, the collar can be mounted from the downstream side (i.e. downstream from the chamber end wall). It is thus possible to give the bowl collar a diameter that is greater than the diameter of the opening in the chamber end wall, such that the thermal protection function of the collar can be provided regardless of the extent to which the injector system becomes off-centered relative to the chamber end wall. In addition, the twist-lock coupling between the two portions of the bowl makes it possible to ensure that the bowl collar does not strike the combustion chamber or the high pressure turbine in the event of a brazed (or welded) connection between those two parts breaking.

According to a disposition of the invention, the bowl end plate presents an engagement ring on its downstream end that carries first teeth that are spaced apart circumferentially and that project radially, and the bowl collar presents an engagement ring coaxial with the engagement ring of the bowl end plate and carrying second teeth that are spaced apart circumferentially and that project radially, the first and second teeth being spaced apart sufficiently to enable the first teeth to pass between the second teeth.

According to another disposition of the invention the arrangement further includes anti-rotation means serving to prevent the bowl end plate turning relative to the bowl collar.

These means may comprise a key that passes through the chamber end wall and that engages at one end in a groove in the bowl collar and at another end in a groove in the bowl end plate.

According to another disposition of the invention, the first teeth project radially inwards and the second teeth project radially outwards.

The collar of the second part of the bowl preferably present a length that is substantially equal to the length of the groove formed by the pinch ring and the annulus.

The bowl collar may be pierced by a plurality of ventilation holes opening out upstream and leading to points facing the collar. Under such circumstances, the bowl collar can present a shoulder projecting radially outwards and serving to prevent the ventilation holes becoming obstructed in the event of the injector system becoming greatly off-centered relative to the chamber end wall.

The bowl collar may be made up of two distinct parts that are fastened to each other by means of brazing or welding.

The invention also provides a combustion chamber and a turbomachine including an arrangement as defined above.

BRIEF DESCRIPTION OF THE DRAWINGS

Other characteristics and advantages of the present invention appear from the following description made with reference to the accompanying drawings that show an embodiment having no limiting character. In the figures:

FIG. 5 is a view corresponding to FIG. 1 in which the injector system is off-center relative to the end wall of the chamber; and FIG. 6 is a fragmentary section view of an arrangement constituting a variant embodiment of the invention.

DETAILED DESCRIPTION OF AN EMBODIMENT

Figure 1:
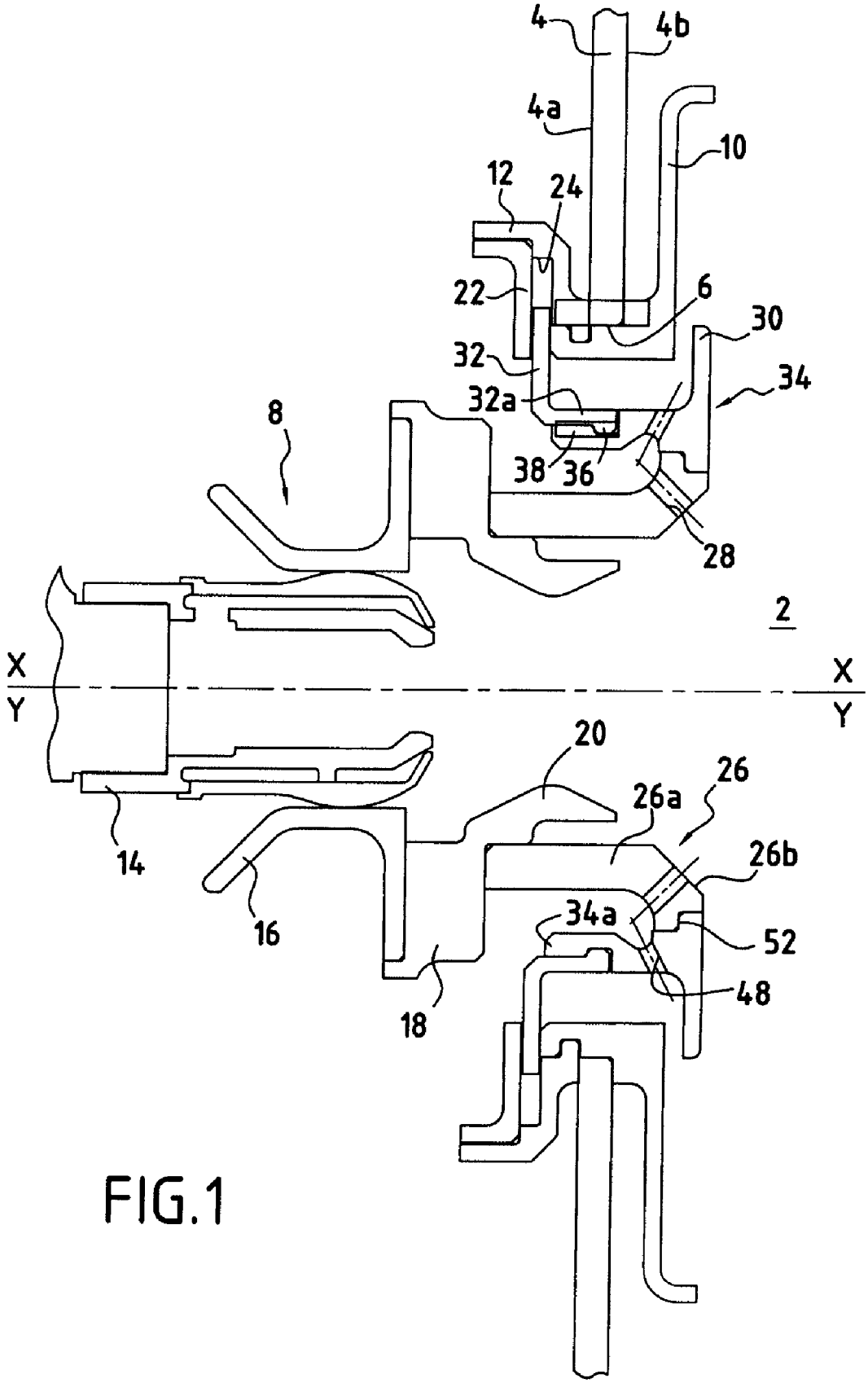
FIG. 1 is a fragmentary section view of a combustion chamber including an arrangement of the invention.

FIG. 1 is a fragmentary section view of a turbomachine combustion chamber 2 fitted with an arrangement of the invention.

In a manner that is itself well known, such a combustion chamber 2 is made up of an inner longitudinal annular wall and an outer longitudinal wall (these walls not being shown in FIG. 1), which walls are interconnected at their respective upstream ends by a transverse annular wall forming the end wall of the chamber.

The chamber end wall 4 presents an upstream side 4*a* and a downstream side 4*b*, the downstream side facing towards the inside of the combustion chamber 2. The chamber end wall is pierced by a plurality of openings 6 that are regularly spaced apart, each being substantially circular in shape about an axis X-X. An injector system 8 for injecting an air-fuel mixture is associated with each of these openings 6.

A deflector 10 protecting the chamber end wall 4 from combustion flames is also mounted in each of the openings 6 on the downstream side 4*b* of the chamber end wall via an annulus 12 projecting from the upstream side.

Each injector system 8 possesses an axis of symmetry Y-Y and comprises in particular a fuel injector secured to the turbomachine casing (not shown in the figures). The head 14 of the fuel injector is disposed on the upstream side 4*a* of the chamber end wall 4 and it is centered on the axis Y-Y of the injector system via a centering ring 16 that surrounds it.

One or more air swirlers 18 optionally provided with respective venturies 20 are secured to the downstream end of the centering ring 16 of the injector system. The air swirler(s) 18 enable(s) air to penetrate into the injector system along an essentially radial direction in order to become mixed with the fuel delivered by the head 14 of the fuel injector. The air/fuel mixture then penetrates into the combustion chamber 2 where it is burnt.

Each injector system 8 also has a "pinch" ring 22 mounted on the upstream side 4*a* of the chamber end wall 4 and fastened against the annulus 12 for holding the deflector 10. The pinch ring 22 is centered on the axis X-X of the opening 6 in the chamber end wall and it co-operates with the annulus 12 to define an annular groove 24 that is open beside the axis X-X.

Each injector system 8 also includes a bowl 26 that is fastened against the downstream end of the air swirler 18 and that serves to ensure that the air/fuel mixture is well distributed in the primary zone of the combustion area.

The bowl 26 is mounted in the corresponding opening 6 of the chamber end wall 4 and is generally in the form of a ring centered on the axis Y-Y of the injector system, in particular with one portion 26*a* that is substantially cylindrical and another portion 26*b* that flares downstream and that is pierced by a plurality of air-introduction holes 28.

The bowl 26 also has at its downstream end an annular collar 30 that extends parallel to the chamber end wall 4, on its downstream side 4*b*. This collar serves in particular to protect the injector system from the flames of the combustion and to fasten the injector system, while also acting as a thermal shield.

Finally, the bowl 26 includes an annular end plate 32 mounted on the upstream side wall 4*a* of the chamber end wall 4 and suitable for sliding radially within the groove 24 formed between the pinch ring 22 and the annulus 12 for holding the deflector 10. The end plate 32 surrounds the cylindrical portion 26*a* of the bowl, being concentric thereabout.

Thus, the head 14 of the fuel injector and the entire injector system 8 are mounted to slide relative to the chamber end wall 4 so as to be capable of accommodating thermal expansion differences between the casing and the combustion chamber. With this type of arrangement, the head 14 of the fuel injector thus remains continuously centered relative to the injector system 8.

According to the invention, the bowl 26 of the injector system 8 is made up of at least two mutually distinct parts, namely at least a first part comprising the annular end plate 32 suitable for sliding in the groove 24, and at least a second part 34 referred to as the bowl collar and comprising in particular the cylindrical portion 26*a*, the flared portion 26*b*, and the thermal protection collar 30. Still according to the invention, the first and second parts of the bowl are fastened to each other by means of a twist-lock coupling system described below.

Figure 2:
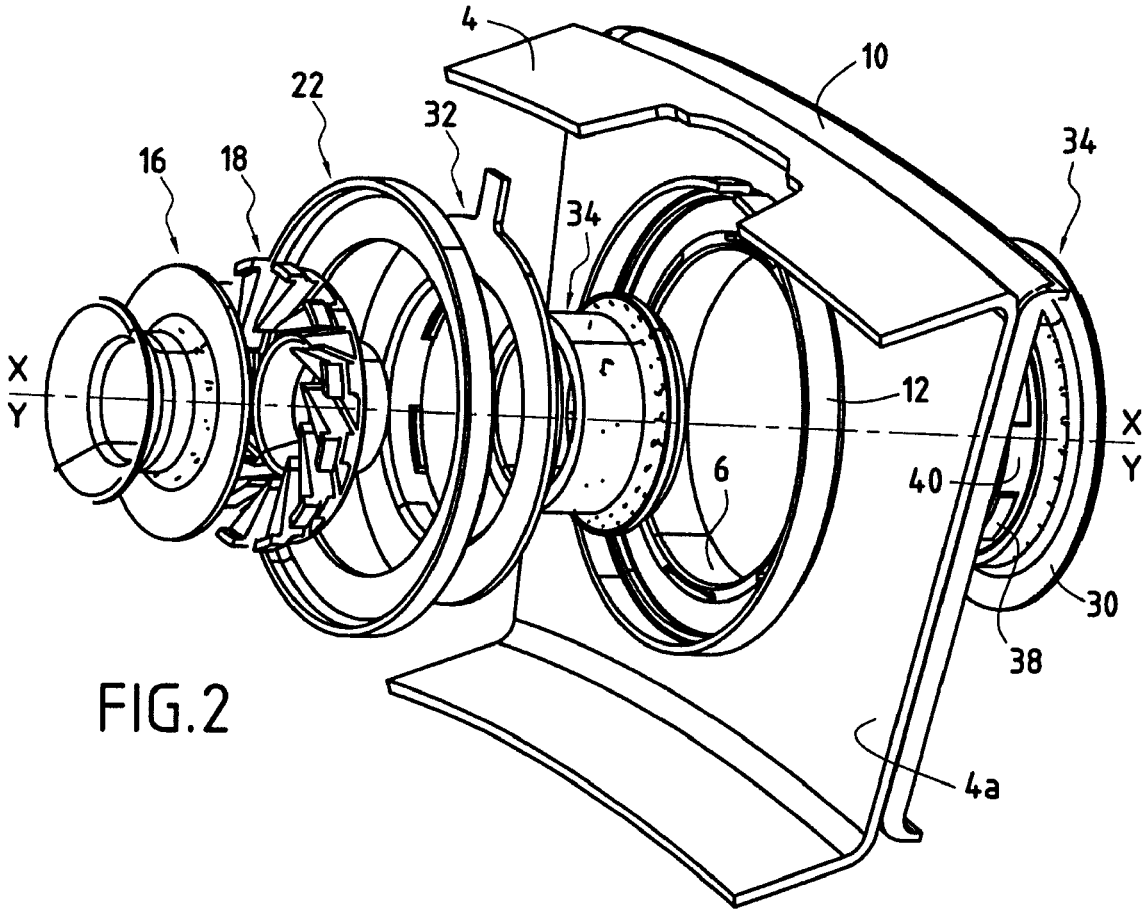
FIG. 2 is an exploded view of the combustion chamber arrangement of FIG. 1.
Figure 3:
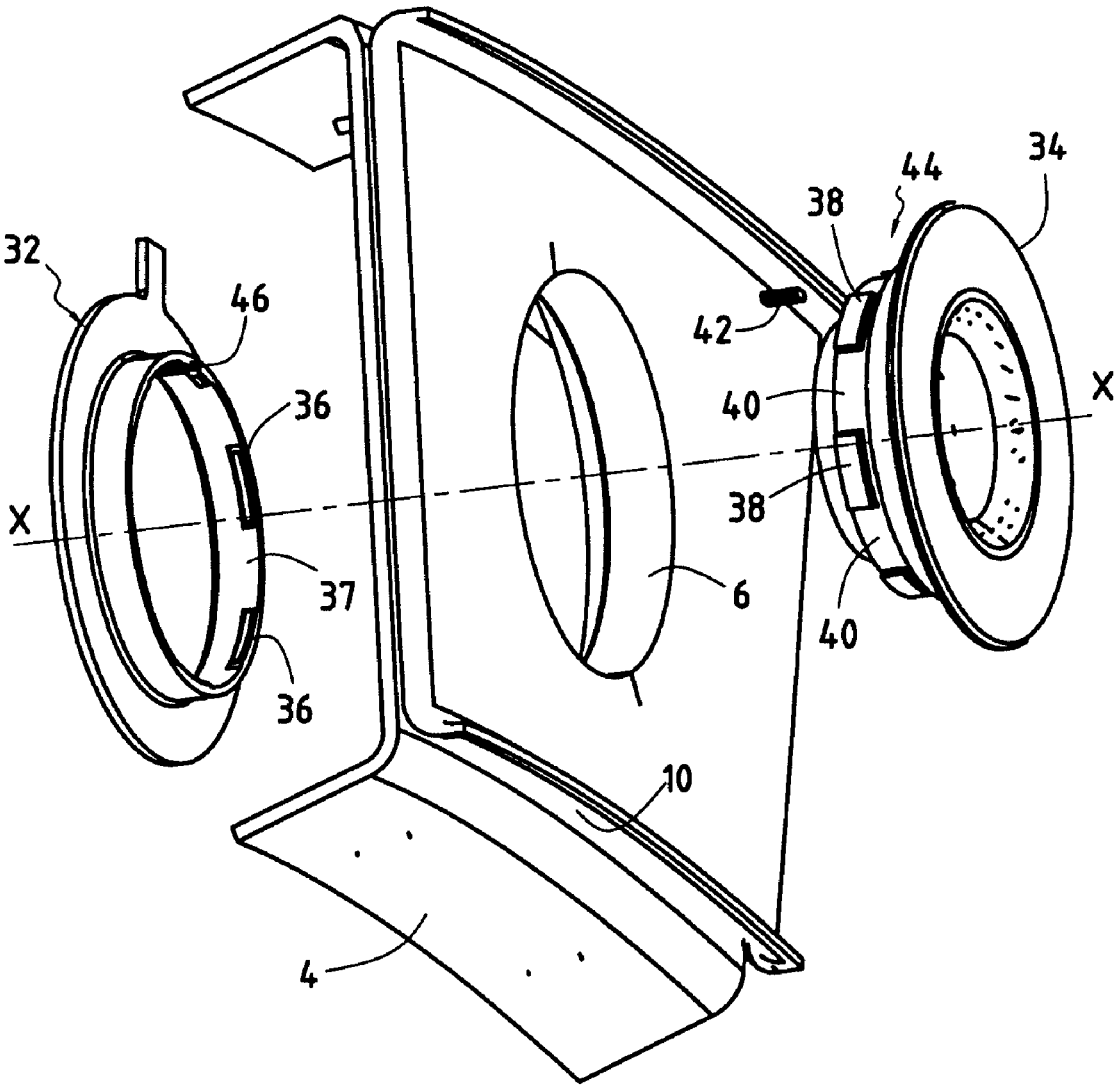
FIG. 3 is another exploded view showing the assembly of the bowl in the arrangement of the invention.
Figure 4:
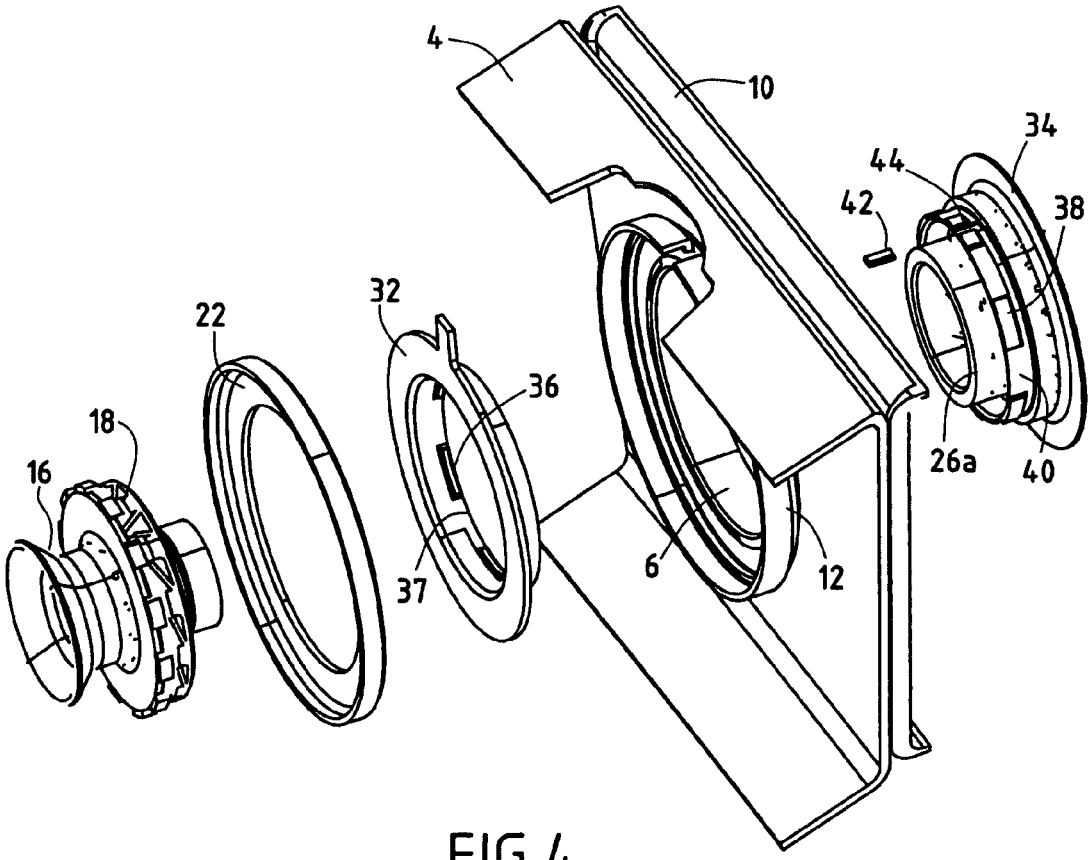
FIG. 4 is another exploded view showing the anti-rotation mounting between the two portions of the bowl in the arrangement of the invention.

The end plate 32 of the bowl 26 presents an engagement ring 32*a* at its downstream end surrounding the cylindrical portion 26*a* of the bowl and carries first teeth (or tenons) 36, e.g. six such teeth in the embodiment shown in FIGS. 2 to 4. These first teeth 36 are regularly spaced circumferentially and project radially inwards (i.e. they are directed towards the axis X-X of the opening in the chamber end wall).

The first teeth 36 alternate all around the circumference of the engagement ring 32*a* of the end plate 32 with notches 37. In the example shown, the circumferential length of each tooth 36 is substantially equal to that of each notch 37 such that with six teeth and six notches, each tooth and each notch extend over an angle of 30°.

In identical manner, the bowl collar 34 presents an engagement ring 34*a* that is coaxial with that of the bowl end plate 32 and of smaller diameter. This ring carries six second teeth 38 that are regularly spaced apart circumferentially and that project radially outwards. These second teeth 38 likewise alternate with notches 40 of substantially equal length (each of the second teeth and the notches thus extends over an angle of 30°).

As a result, the teeth 36 of the end plate 32 and the teeth 38 of the bowl collar 34 are spaced apart sufficiently to enable the teeth of the end plate to pass between the teeth of the bowl collar (and vice versa).

The arrangement of the invention further includes anti-rotation means serving to prevent the end plate 32 of the bowl 26 turning relative to the bowl collar.

In the embodiment of FIGS. 3 and 4, these means are implemented by a key 42 passing through the chamber end wall 4 and engaging at one end in an axial groove 44 formed in one of the teeth 38 of the bowl collar 34 (FIG. 4) and at an opposite end in an axial groove 46 formed in one of the teeth 36 of the end plate 32 (FIG. 3).

The arrangement of the invention is mounted as follows. The annulus 12 for holding the deflector, the end plate 32 of the bowl 26, and the pinch ring 22 are mounted from the upstream side (i.e. from the side 4*a* of the chamber end wall 4) and they are fastened to one another (e.g. by brazing or by welding). The deflector 10 is mounted in the opening 6 in the chamber end wall 4 from the downstream side (i.e. from the side 4*b* of the chamber end wall) and is then fastened to the annulus 12. The bowl collar 34 is also mounted in the opening 6 from the downstream side (see FIGS. 3 and 4). The bowl end plate 32 and the bowl collar 34 are then turned so that their grooves 44, 46 for inserting the anti-rotation key are in axial alignment. The bowl collar 34 is then turned through a fraction of a turn so that the teeth 36 of the engagement ring 32*a* of the end plate are axially aligned with the notches 40 of the engagement ring 34*a* of the bowl collar (and vice versa). In the example described having six teeth and six notches, the bowl collar thus needs to be turned through 30°. The engagement ring 34*a* of the bowl collar is then engaged under the ring of the end plate, the first teeth 36 passing between the second teeth 38. With the bowl collar engaged in this way, it is turned through 30° in the direction opposite to the preceding direction so that the grooves 44, 46 for inserting the key are again in alignment and so that the teeth 36 of the end plate 32 are engaged behind the teeth 38 of the bowl collar 34. The key 42 is then inserted in the two grooves 44, 46 so as to prevent the bowl collar from turning relative to the bowl end plate. The air swirler 18 and the centering ring 16 are then mounted from the upstream side.

All of the parts constituting the arrangement are finally fastened to one another by brazing or by welding. In particular, the respective engagement rings 32*a*, 34*a* of the first part 32 and of the second part 34 of the bowl 26 are also brazed or welded together, in addition to their twist-lock couplings.

It will be understood that even in the event of a break in the brazing or welding interconnecting the two bowl parts, the bowl collar 34 continues to be retained by its teeth 38 being engaged behind the teeth 36 of the end plate. Thus, even in the event of the brazing or welding being faulty, the bowl collar 34 cannot drop into the combustion chamber 2.

It should be observed that the process whereby the parts of the arrangement are assembled can be varied. All of the parts can be fastened to one another by brazing or welding after they have been mounted, but it is also possible to begin by separately mounting subassemblies of parts which are subsequently fastened together (e.g. the chamber end wall, the deflector, and the annulus can form a subassembly).

It should also be observed that in the embodiment shown in FIGS. 2 to 4, the teeth 36 of the end plate 32 are directed radially inwards while the teeth 38 of the bowl collar 34 are directed radially outwards. Nevertheless, it is possible to envisage an opposite configuration with the engagement ring 34 of the bowl collar having a diameter greater than that of the end plate 32.

With the arrangement of the invention, it can be understood that given that the second part 34 of the bowl 26 is mounted from the downstream side, the collar 30 of said second part of the bowl can present a diameter greater than the diameter of the opening 6 in the chamber end wall 4, thereby providing effective protection to the injector system against combustion flames regardless of the extent to which the injector system is offset relative to the chamber end wall.

In particular, it is possible to prevent combustion flames damaging the bowl end plate 32 regardless of the extent to which the injector system 8 is off-center relative to the chamber end wall 4. This characteristic of the invention can be seen in FIG. 5. This figure shows one of two possible configurations in which the injector system is maximally off-center relative to the chamber end wall. In particular the axis of symmetry Y-Y of the injector system is maximally offset radially inwards relative to the axis X-X of the opening in the chamber end wall (compared with the disposition shown in FIG. 1 in which there is no off-centering). In this situation, the diameter of the collar 30 of the second part 34 of the bowl is such as to enable it to cover the end plate 32 of the injector system radially so as to protect it against combustion flames.

According to an advantageous characteristic of the invention, the length of the collar 30 of the second part 34 of the bowl is also substantially equal to the length of the groove 24 formed between the pinch ring 22 and the annulus 12 for holding the deflector.

According to another advantageous characteristic of the invention, the bowl collar 34 is pierced by a plurality of ventilation holes 48 opening out upstream and leading to a point facing the collar 30. Such holes serve to create a film of air flowing radially along the downstream side of the deflector so as to cool it. In addition, by guiding air radially, the collar 30 serves to prevent cooling air from penetrating directly into the combustion area, which might affect pollution parameters.

According to yet another advantageous characteristic of the invention, the engagement ring 34*a* of the bowl collar 34 presents an annular shoulder 50 projecting radially outwards. Thus, in the other circumstance in which the injector system 8 is maximally off-center relative to the chamber end wall 4, as shown in FIG. 6, such a shoulder 50 comes into radial abutment against an inside face of the deflector 10, thus making it possible in such a situation to ensure that the deflector does not block the ventilation holes 48 in the bowl collar.

It should be observed that the second part 34 of the bowl 26 could itself be made up of two mutually distinct parts that are fastened together by means of welding or brazing 52 (FIG. 1). For example, and as shown in particular in FIGS. 1 and 2, the bowl collar may be divided into a part provided with the collar 30 and the engagement ring 34, and a second part having the cylindrical portion 26*a* and the flared portion 26*b* of the bowl. Such an arrangement makes it easy to provide the ventilation holes 48 in the bowl collar by machining. Alternatively, the bowl collar could be made as a one-piece casting, as shown in FIGS. 3 and 4.

What is claimed is:

1. An arrangement for a turbomachine combustion chamber, the arrangement comprising a chamber end wall pierced by at least one substantially circular opening, an injector system associated with the opening, and a deflector mounted on the downstream side of the chamber end wall in the opening by means of an annulus, said injector system comprising:

a pinch ring mounted on the upstream side of the chamber end wall and fastened against the annulus together defining an annular groove that is open towards the axis of the opening in the chamber end wall; and an annular bowl mounted in the opening in the chamber end wall;

wherein said bowl is made up of at least two distinct parts, at least a first part forming an annular end plate suitable for sliding radially in the groove formed by the pinch ring and the annulus, and a second part forming a bowl collar that is provided with an annular collar extending parallel to the chamber end wall on its downstream side, said first and second bowl portions being fastened together by means of a twist-lock coupling.

2. An arrangement according to claim 1, in which the end plate of the bowl presents at its downstream end an engagement ring carrying first teeth that are circumferentially spaced apart and that project radially, and the bowl collar presents an engagement ring coaxial with the engagement ring of the bowl and carrying second teeth that are circumferentially spaced apart and that project radially, the first and second teeth being spaced apart sufficiently to allow the first teeth to pass between the second teeth.

3. An arrangement according to claim 1, further comprising anti-rotation means serving to prevent the bowl end plate from turning relative to the bowl collar.

4. An arrangement according to claim 3, in which the anti-rotation means comprise a key passing through the chamber end wall and engaged at one end in a groove in the bowl collar and at an other end in a groove of the bowl end plate.

5. An arrangement according to claim 2, in which the first teeth are directed radially inwards and the second teeth are directly radially outwards.

6. An arrangement according to claim 1, in which the collar of the second part of the bowl presents a length that is substantially equal to the length of the groove formed by the pinch ring and the annulus.

7. An arrangement according to claim 1, in which the bowl collar is pierced by a plurality of ventilation holes opening out upstream and leading to points facing the collar.

8. An arrangement according to claim 7, in which the bowl collar presents a shoulder projecting radially outwards for preventing the ventilation holes becoming obstructed in the event of the injector system becoming highly off-center relative to the chamber end wall.

9. An arrangement according to claim 1, in which the bowl collar is made up of two distinct parts that are fastened to each other by means of welding or brazing.

10. An arrangement according to claim 1, in which the injector system further includes at least one air swirler fastened to the upstream end of the bowl collar, and a centering ring fastened to the upstream end of the air swirler and surrounding a fuel injector.

11. A turbomachine combustion chamber including an arrangement according to claim 1.

12. A turbomachine including an arrangement according to claim 1.

* * * * *

UNITED STATES PATENT AND TRADEMARK OFFICE

CERTIFICATE OF CORRECTION

PATENT NO. : 7,478,534 B2
APPLICATION NO. : 11/770309
DATED : January 20, 2009
INVENTOR(S) : Guezengar et al.

It is certified that error appears in the above-identified patent and that said Letters Patent is hereby corrected as shown below:

On the title page, the Terminal Disclaimer information should be removed. Item (45) and the Notice information should read as follows:

-- (45) Date of Patent: Jan. 20, 2009

(*) Notice: Subject to any disclaimer, the term of this patent is extended or adjusted under 35 U.S.C. 154(b) by 26 days. --

Signed and Sealed this

Seventh Day of April, 2009

JOHN DOLL
*Acting Director of the United States Patent and Trademark Office*